US007887151B2

(12) United States Patent
Yamada et al.

(10) Patent No.: US 7,887,151 B2
(45) Date of Patent: Feb. 15, 2011

(54) METHOD FOR ADJUSTING UNIFORMITY OF LIQUID EJECTION FROM A LIQUID EJECTION HEAD

(75) Inventors: Takahiro Yamada, Hokota (JP); Hitoshi Kida, Hitachinaka (JP); Tomohiko Koda, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 142 days.

(21) Appl. No.: 12/034,468

(22) Filed: Feb. 20, 2008

(65) Prior Publication Data

US 2008/0291232 A1 Nov. 27, 2008

(30) Foreign Application Priority Data

Feb. 20, 2007 (JP) ..... 2007-039074

(51) Int. Cl.
*B41J 29/38* (2006.01)

(52) U.S. Cl. ..... 347/14; 347/9; 347/12; 347/19; 347/68

(58) Field of Classification Search ..... None
See application file for complete search history.

(56) References Cited

U.S. PATENT DOCUMENTS

| | | | | |
|---|---|---|---|---|
| 6,700,307 | B2 | 3/2004 | Kitahara | |
| 6,732,414 | B2 | 5/2004 | Kitahara | |
| 6,955,421 | B2 | 10/2005 | Kitahara | |
| 2002/0158553 | A1 * | 10/2002 | Kitahara | 310/328 |
| 2005/0104921 | A1 * | 5/2005 | Watanabe et al. | 347/19 |
| 2006/0010670 | A1 | 1/2006 | Kitaharay | |
| 2006/0268072 | A1 | 11/2006 | Yamada et al. | |
| 2007/0132813 | A1 | 6/2007 | Yamada et al. | |

FOREIGN PATENT DOCUMENTS

| | | | |
|---|---|---|---|
| JP | 10-193601 | A | 7/1998 |
| JP | 2001-277525 | A | 10/2001 |

* cited by examiner

*Primary Examiner*—Matthew Luu
*Assistant Examiner*—Justin Seo
(74) *Attorney, Agent, or Firm*—Oblon, Spivak, McClelland, Maier & Neustadt, L.L.P.

(57) ABSTRACT

An image forming apparatus having a liquid ejection head including a plurality of nozzles for ejecting droplets and a plurality of piezoelectric elements for generating a pressure for discharging droplets in respective nozzles. The image forming apparatus includes a polarization adjustment unit that performs a polarization adjustment in parallel for adjustment of target nozzles.

10 Claims, 8 Drawing Sheets

METHOD FOR ADJUSTING UNIFORMITY OF LIQUID EJECTION FROM A LIQUID EJECTION HEAD

CROSS REFERENCE TO RELATED APPLICATIONS

This application is related to and claims priority under 35 U.S.C. §1.119 to Japanese Patent Application No. 2007-039074, filed on Feb. 20, 2007, the entire contents of which being hereby incorporated herein by reference.

BACKGROUND OF THE INVENTION

1. Field of the Invention

This present invention relates to image forming apparatuses and manufacturing processes for producing ejection heads, and more particularly, relates to image forming apparatuses with a liquid ejection head using PZT actuator and to manufacturing processes and system for production of an liquid ejection head with uniform liquid injection from different nozzles.

2. Description of the Related Art

Image forming apparatus such as a printer, a copier and a facsimile, and also a multi function type device combining these machine's functions are generally known. The image forming apparatus, for example, has at least one recording head ejecting droplets of ink and forming images by attaching the ink to a recording or transfer medium such as for example a recording sheet or paper being transferred in the image forming apparatus. The term of "medium" as used herein refers to "paper" as generally used in this field but is not limited to merely paper but refers also to any material, or recording medium, or transfer material, or recording sheet, and so on.

Additionally, the term "image forming apparatus" as used herein and as generally used in this field refers to a device discharging a liquid into a medium, such as paper, thread/string, fiber, textiles, leather, metal, plastic, glass, wood/lumber, ceramics, and the like. Further, the term "image forming" as used herein and as generally used in this field refers to an image being formed onto a medium, such as the forming of letters, characters, figures, and transferred patterns, and so on one or more of the mediums listed above.

The liquid ejection head as used herein and as generally used in this filed refers to piezoelectric type heads using piezoelectric actuators. In particular, piezoelectric type heads use a plurality of piezoelectric devices which can pressure ink in a reservoir communicating with a corresponding nozzle, can deform a member (or diaphragm) on one side of the surface of the reservoir (capable of elastic deformation), and can eject the liquid (or ink) by changing a volume and a pressure in each reservoir.

One image forming apparatus using the above described liquid ejection head as used herein and as generally used in this field is a line-type image forming apparatus having a line-type ejection head which can have a plurality of nozzles aligned along a paper edge entirely, and can record images onto a medium which is transferred to an orthogonal direction against the paper width at high-speed and on one-pass without necessarily using head scanning.

Such a line-type image forming apparatus can produce high quality images at high speed and high reliability. So, the uniformity of droplet ejection characteristics between each nozzle of the line-type ejection head is an important criterion.

For this reason, a head, which exhibits a narrow range of droplet ejection speed and volume variation of droplets, is considered desirable.

However, it is known that a piezoelectric actuator for a high ejection frequency nozzle is prone to change its characteristics more readily than that for a lower frequency nozzle. It is also known that the characteristics of a piezoelectric actuator can gradually change over time because of changes of the environmental temperature around the actuator. Therefore, the droplet ejection characteristics between each nozzle of the recording head can gradually vary over time, so the recorded image quality can degrade.

Japanese Unexamined Patent Application Publication No. 10-193601 describes an ink jet recording apparatus that is equipped with a repolarization device which attempts to recover the characteristics of piezoelectric actuators by repolarizing the piezoelectric actuators after use. However, the repolarizing all nozzles through the application of a constant polarization voltage sometimes does not recover a variation of droplet ejection characteristics sufficiently.

Japanese Unexamined Patent Application Publication No. 2001-277525 describes a polarization adjustment method for piezoelectric actuators that adjusts a polarization degree of a piezoelectric actuator of each nozzle of a recording head. This method improves a variation of droplet ejection speeds or droplet volumes between nozzles. However, Japanese Unexamined Patent Application Publication No. 2001-277525 describes that this method applies to a head manufacturing apparatus. Moreover, this method adjusts the polarization degree with respect to each nozzle one by one, in such a way that a polarization adjustment of a plurality of processes is completed in response to one of adjustment target nozzles, and next, in response to another.

SUMMARY

A first aspect in accordance with the invention provides a image forming apparatus having a liquid ejection head which has plural nozzles for ejecting droplets and has plural piezoelectric elements configured to generate in respective nozzles a pressure for discharging droplets from selected ones of the nozzles. The image forming apparatus includes a polarization adjustment unit configured to adjust polarization degrees of a set of the piezoelectric elements in parallel based on a prior evaluation of the polarization degrees of the set of the piezoelectric elements.

A second aspect in accordance with the invention provides a head manufacturing system which manufactures a liquid ejection head having plural nozzles for ejecting droplets and plural piezoelectric elements configured to generate a pressure for discharging droplets from selected ones of the nozzles. The head manufacturing system includes a polarization adjustment unit configured to adjust polarization degrees of a set of the piezoelectric elements in parallel based on a prior evaluation of the polarization degrees of the set of the piezoelectric elements.

It is to be understood that both the foregoing general description of the invention and the following detailed description are exemplary, but are not restrictive of the invention.

DESCRIPTION OF THE INVENTION

A relative adjustment of the performance of one nozzle relative to another as described in Japanese Unexamined Patent Application Publication No. 2001-277525 does not provide overall compensation for environmental factors which can impact the entire set of piezoelectric actuators. For instance, adjusting a polarization of each piezoelectric actuator in the nozzle in serial one by one basis, especially since the time involved can be extensive, can result nonetheless in a set of non-uniform nozzles.

In other words, since a line-type head needs to adjust many nozzles, due to its long length and the numerous nozzles, many repetitive adjustments until a polarization adjustment is finished are required in order for all nozzles of a head to be properly adjusted.

Unfortunately, it is difficult to keep the environmental conditions the same for all nozzles during the re-polarization adjustment. For example, it is hard to maintain a temperature of a recording head (or of an ink in the head) constant over the re-polarization adjustment time period. Further, since environmental conditions often vary, because of this, it is difficult to make a polarization adjustment with high precision.

The present invention provides an image forming apparatus and manufacturing processes for producing an ejection head with more uniform nozzle ejection, as compared to the conventional practice, where the environmental factor impact is reduced, as the polarization of piezoelectric elements corresponding to all nozzles occurs with precision in a short time.

Figure 1:
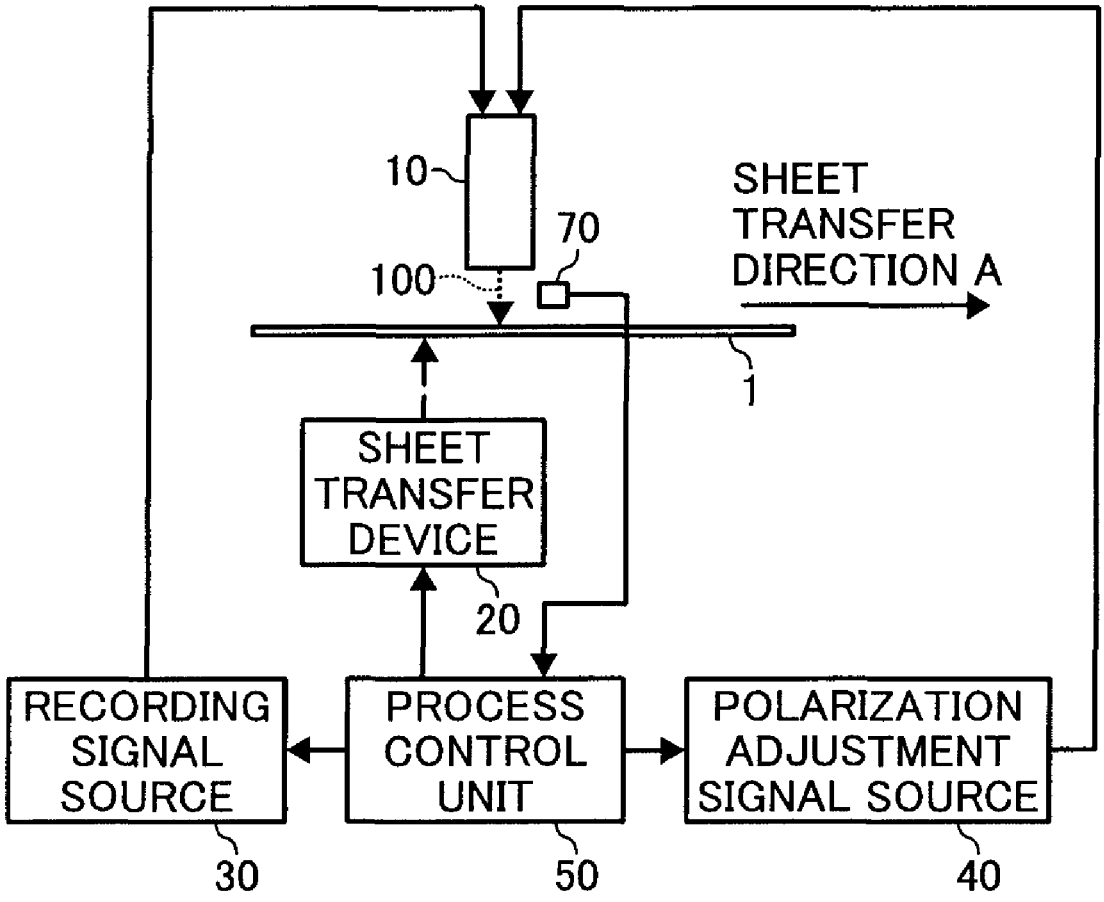
FIG. 1 shows a schematic view of an image forming apparatus in accordance with a first embodiment of the prevent invention.
Figure 2:
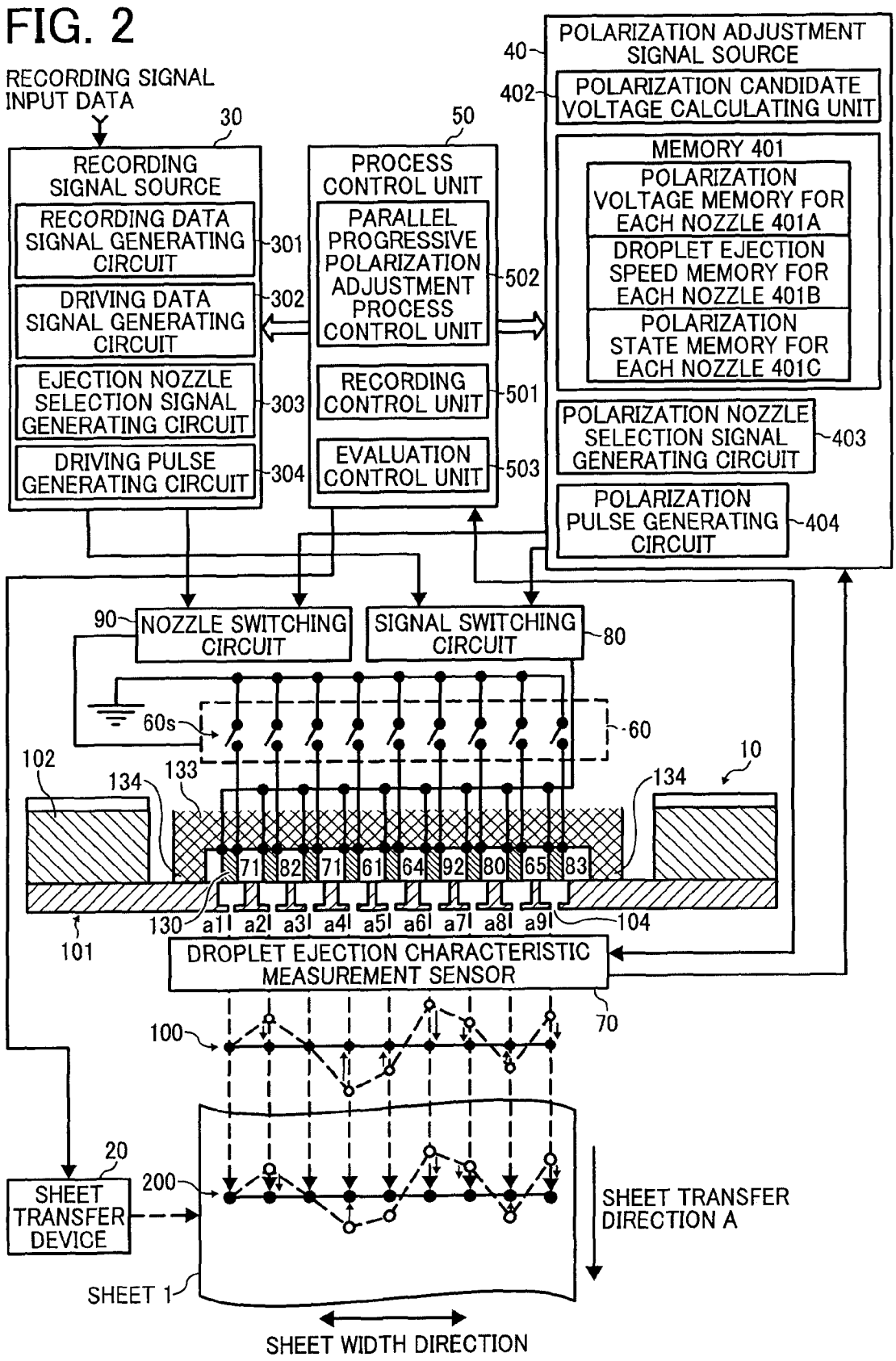
FIG. 2 is an explanatory diagram of FIG. 1.

Hereinafter, various embodiments of the invention are described with reference to the drawings. An image forming apparatus as a first embodiment of the invention will be described with reference to FIG. 1 and FIG. 2. FIG. 1 is a schematic view of the image forming apparatus, and FIG. 2 is an explanatory diagram of FIG. 1.

The image forming apparatus of FIG. 1 includes a line-type recording head 10 that is formed by a liquid ejection head ejecting a droplet onto a sheet 1, a sheet transferring device 20 that transfers the sheet 1 to the direction (a sheet transfer direction A) orthogonal to the nozzles arrangement direction of the line-type recording head, a recording signal generating unit 30 that generates and outputs a signal to drive the line-type recording head 10 in response to recording data, a polarization adjustment signal generating unit 40 that generates and outputs a polarization adjustment signal to adjust a polarization of piezoelectric elements in the line-type recording head 10, a process control device unit 50 that handles control over the whole image forming apparatus, and a droplet ejection characteristic measurement sensor 70. Further, as shown in FIG. 1, sheet 1 is placed opposite the nozzles of the line-type recording head 10. These nozzles are shown in FIG. 2 as a part of nozzle array 104.

The line-type recording head 10 has nozzles aligned in the direction of a sheet width at a prescribed spacing along the length of the sheet width, and the nozzles 104 are arranged to face to the print side of sheet 1. FIG. 2 shows only nine nozzles in nozzle array 104, in order to simplify the drawing, although many more nozzles are present in practice. In an actual image forming apparatus, for example, 2,700 nozzles are generally arranged in the line-type recording head 10 for recording onto sheet 1 for example having a width of 9-inch at 300 dots per inch (dpi). Furthermore, sheet 1 is transferred to a sheet transfer direction (e.g., the direction of arrow A in FIG. 1) at a high speed by the sheet transfer device 20. Therefore, the line-type recording head 10 is configured to print onto sheet 1. Sheet 1 can be also cut sheet or continuous sheet (i.e., a roll sheet).

Figure 3:
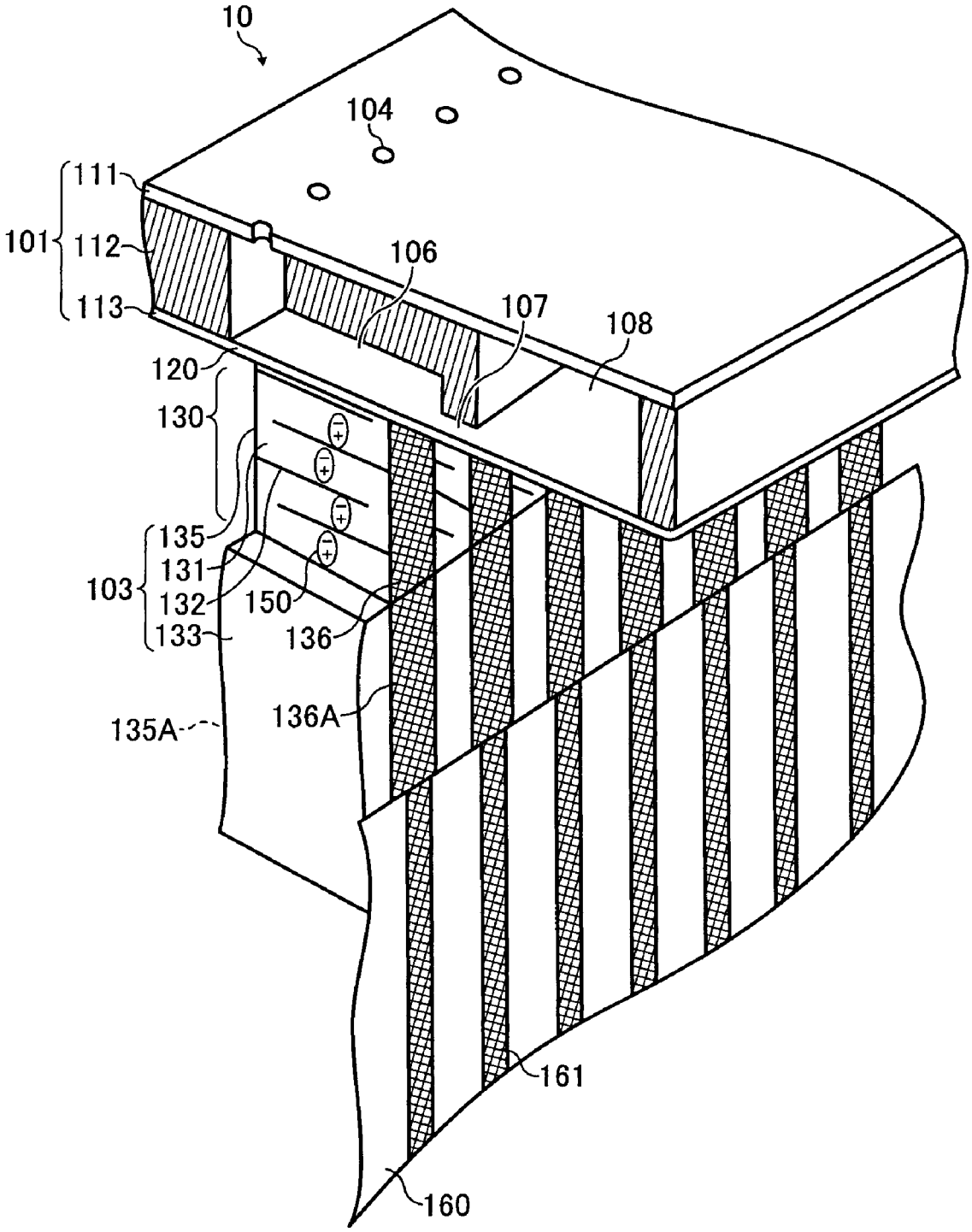
FIG. 3 shows partially a perspective, cross-sectional view of a line-type recording head of an image forming apparatus.

One line-type recording head 10 will now be described with reference to FIG. 3. FIG. 3 shows partially-exploded perspective of a cross-sectional view of a droplet ejection head of a line-type recording head 10. The line-type recording head 10 includes a flow channel unit 101, a head housing 102 (see FIG. 2) holding the flow channel unit 101, and a piezoelectric element unit 103 that is a piezoelectric actuator.

The flow channel unit 101 of FIG. 3 is a layered-structure including an orifice plate (nozzle plate) 111, a flow channel unit 112, and a diaphragm plate 113, as shown in FIG. 3. In the orifice plate 111, there are n-nozzles (or nozzle opening) 104 arranged at a prescribed pitch. The flow channel plate 112 has channels in communication from a common chamber 108 to each pressure chamber 106 that is connected to the nozzle 104, via an incurrent opening 107 which supplies ink to plural pressure chambers 106. The diaphragm plate 113 has a diaphragm member 120 that forms one side of the pressure chamber 106 and that is deformable.

The piezoelectric element unit 103 is cut into a comb-shape from a bar to form a stacked polarization element 130 (hereinafter called a rod-like piezoelectric element) and is adhered to a piezoelectric element support block 133 with an adhesive and the like. Further, one end of the rod-like piezoelectric element 130 is placed onto an opposite surface of the pressure chamber 106 in the diaphragm member 120. Here, the end of the rod-like piezoelectric element 130 is in contact with the diaphragm member 120 and is fixed to the diaphragm member 120 for example via an adhesive-layer. Moreover, there is a pair of pillar shaped block fixing member 134 for supporting piezoelectric element 130 on both sides of the piezoelectric support block 133, in an arranging direction of the piezoelectric elements. The bottom faces of the piezoelectric member 130 are adhered to the flow channel unit 101 with an adhesive and the like.

As shown in FIG. 2, the flow channel unit 101 is adhered/fixed to the head housing 102 nearby the pillar shaped block fixing member 134. The flow channel unit 101 supports block fixing member 134. This means that the face of the piezoelectric support block 133 is fixed to the head housing 102 though the flow channel unit 101. As shown in FIG. 2, the piezoelectric support block 133 (including the pillar shaped block fixing member 134) is not directly connected to head housing unit 102. Rather, flow channel unit 101 connects these units together.

Further, the rod-like piezoelectric element 130, as shown in FIG. 3, is structured as a layered structure, in which plural layered piezoelectric elements 131 are layered alternating with a layered electrode 132. The layered electrodes 132 are electrically connected alternately with a common electrode 135 and an individual electrode 136, the common electrode 135 and the individual electrode 136 are formed on each flank of the rod-like piezoelectric element 130.

The common electrode 135 and the individual electrode 136 are connected respectively to a common electrode 135A and an individual electrode 136A formed on the piezoelectric element support block 133. Further, the common electrode 135A and the individual electrode 136A are connected respectively to a flexible cable terminal 161 of flexible cable 160.

Each layered piezoelectric element 131 of the rod-like piezoelectric actuator 130 has a residual (or retained) polarization 150. The residual or retained polarization 150 is formed by a polarization voltage applied between the common electrode 135 and the individual electrode 136. The level of residual or retained polarization 150 is adjustable by changing a polarization degree of a piezoelectric element, by changing a polarization condition such as for example a level of polarization voltage and/or a temperature condition during polarizing. In one embodiment, the polarization degree is adjusted by changing polarization voltage while keeping a temperature of polarization process at or near room temperature.

Referring to FIG. 1 and FIG. 3, the line-type recording head as described above, the individual electrode 136 connected to ground via the flexible cable 160, a switching element array 60, and the common electrode 135 are connected to the recording signal source 30 or to the polarization adjustment signal source 40 via signal switching circuit 80.

Ahead of the nozzle 104 of line-type recording head 10, there is a droplet ejection characteristic measurement sensor 70 to measure an ejection speed or a volume of ink droplet 100 ejected from each nozzle 104. The droplet ejection characteristic measurement sensor 70 includes a CCD (charge-coupled device) sensor array using CCD sensor elements over one pixel corresponding each nozzle 104. An ink droplet image is focused in a photoreceptor of the CCD sensor array, and the droplet ejection speed and volume are measured by using for example a time measurement of output signal of a sensor, or a measurement of the number of sensing pixels and so on.

For the droplet ejection characteristic sensor 70, it is possible to use a sensor that has a laser beam emitter and a photoreceptor. The droplet ejection characteristic sensor can detect an ink droplet 100 passing between the laser beam emitter and the photoreceptor by the photoreceptor. Further, it is also possible to measure droplet characteristics by scanning a sensing device along the nozzle line (e.g., line of nozzles 104) for all nozzles measurement, or when only some droplets from nozzles 104 in a part of line-type recording head 10 can be scanned.

The recording signal source 30 includes a recording data signal generating circuit 301 that generates a recording data signal according to an output image, a driving data signal generating circuit 302 that generates a driving data signal driving each piezoelectric element 130 of the line-type recording head 10 according to the recording signal, an ejection nozzle selection signal generating circuit 303 that selects the piezoelectric element 130 to drive for ejecting a droplet at each piezoelectric element 130 in response to each nozzle 104 of line-type recording head 10, and a driving pulse generating circuit 304 that generates the driving pulse to drive the piezoelectric element 130.

The polarization adjustment signal source 40 includes a data memory 401 for each nozzle targeting adjustment, a polarization voltage memory 401A storing polarization candidate voltages, an ejection speed memory 401B storing droplet ejection speeds, and a polarization state memory 401C storing evaluation results of polarization state. The polarization adjustment signal source 40 also includes a polarization candidate voltage calculating unit 402 to calculate polarization candidate voltages, a polarization nozzle selecting signal generating circuit 403 that generates a selection signal to select a piezoelectric element 130 for applying a polarization voltage (polarization pulse), and a polarization pulse generating circuit 404 that generates polarization pulse to polarize the piezoelectric element 130.

The process control unit 50 includes a parallel progressive polarization adjustment process control unit 502 that controls a parallel progressive polarization adjustment process of the invention which repetitively adjusts the polarization of selected ones of the polarization elements as needed to obtain a target polarization for the set of polarization elements. The process control unit 50 includes a recording control unit 501 that controls the image forming by controlling the recording signal source 30, and an evaluation control unit 503 that controls the polarization adjustment signal source 40 and evaluates adjustment states in a polarization adjustment. In the embodiment of the invention, a parallel progressive polarization adjustment unit includes the polarization adjustment signal source 40, the parallel progressive polarization adjustment process control unit 502, and the evaluation control unit 503.

Selection signals generated by the ejection nozzle selection signal generating circuit 303 of the recording signal source 30 and selection signals generated by the polarization nozzle selecting signal generating circuit 403 of the polarization adjustment signal source 40 are provided to a switching element array 60 via a nozzle switching circuit 90, and each switching element 60*s* constructing the switching element array 60 is switched on/off in response to the selection signals. Driving pulses generated by the driving pulse generating circuit 304 of the recording signal source 30 and polarization pulses generated by the polarization pulse generating circuit 404 of the polarization adjustment signal source 40 are provided to the common electrode 135 of the line-type recording head via the signal switching circuit 80.

Further, in the process device, the recording signal source 30, polarization adjustment signal source 40, and process control unit 50 do not need to be separated from each other in hardware, as it is possible to share resources such as a CPU or a memory in the same computer system.

Next, the recording operation in the image forming apparatus described above is explained. First, a recording signal input data (e.g., image data) from a higher-level device (not shown) (e.g., a host device, for example, a information processing device like PC, etc.) are input to the recording signal source 30. Recording data signals are generated by the input signals at the recording data signal generating circuit 301, and driving data signals are generated by the recording data signals at the driving data signal generating circuit 302. According to receiving, the driving data signal and selection control signal are generated at the nozzle selection generating circuit 303, the nozzle switching circuit 90 receives the selection signals controls each switching element 60*s* of the switching element array 60 by ON/OFF switching, and prescribed switching elements 60*s* are grounded.

A piezoelectric element 130 connected to the switching element 60*s* of ON state is driven according to the applied driving pulses, because common electrode 135 of each piezoelectric element 130 of line-type recording head 10 is connected to the driving pulse generating circuit 304. A driven piezoelectric element 130 changes a volume in the pressure chamber 106 via the diaphragm member 120; thereby, ink droplet 100 is ejected from the corresponding nozzle 104. An ejected ink droplet 100 lands in sheet 1 moving to the direction of arrow A, and forms a recording dot 200. By the recording operation as described above, the gathering recording dots are recorded on the recording sheet 1.

Next, a summary of polarization adjustment operation in the image forming apparatus will be described with reference to FIG. 6 as described below. In the piezoelectric element polarizing procedure, the polarization adjustment signal source 40 is driven, and selection signals from the polarization selection signal generating circuit 403 of the polarization adjustment signal source 40 are provided to the switching element array 60 via the nozzle switching circuit 90. The switching element 60*s*, that connected to the individual electrode 136 in response to the nozzle 104 of polarization target (adjustment target), switches to ON states and is grounded. Meanwhile, the common electrode 135 of the piezoelectric element 130 is connected to the polarization pulse generating circuit 404. Accordingly, the piezoelectric element polarization pulse is applied to the piezoelectric element 130 connected to the switching element 60*s* in the ON state. Therefore, the polarization element 130 provided the polarization pulse becomes polarized. Further, the numerals "71", "82", "71", "61, . . . , 65", "83" beside each piezoelectric element 130 in FIG. 2, is an example of a level of polarization degree after finishing the polarization adjustment process of the invention.

In a explanatory diagram of FIG. 2, for example, dashed lines extend downward from each nozzle 104 are flight trajectories of the droplet 100. The positions indicated by circles at the end of the arrows of these dashed lines are indicative of where the flight position of the droplets 100 are at predetermined amount of time after the piezoelectric element 130 applies the driving signals and after the droplets 100 have been ejected from nozzles 104. A white circle indicates the flight position before the polarization adjustment, and a black circle indicates the flight position after the polarization adjustment. An indication of only a black circle indicates that flight position is the same between before and after the polarization adjustment. Further, the dashed line laterally-connecting white circles is for reference to understand graphically the variation of flight position before adjusting polarization, and the horizontal solid line is also provided as a reference line after the polarization adjustment of the invention is implemented.

Figure 6:
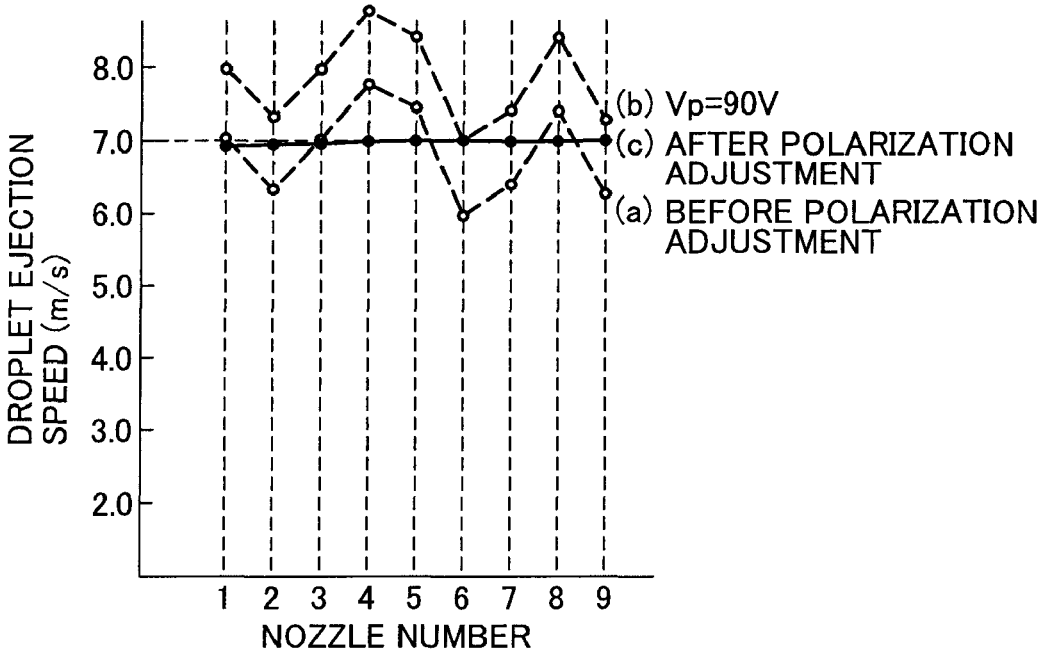
FIG. 6 and FIG. 7 are characteristic graphs of droplet ejection speeds in each nozzle.

FIG. 6 shows an example of variations of droplet ejection speeds in each nozzle before polarization adjustment, in case that a piezoelectric element driving voltage of each nozzle is 26 V. The horizontal axis is a respective nozzle number (the number of nozzles 104, in FIG. 2, illustrated as a1 nozzle, a2 nozzle, . . . a9 nozzle from left to right) and the vertical axis is droplet ejection speed in m/s. The nozzle numbers correspond to respective ones of the nozzles 104 of the recording head in FIG. 2. In (a), (b), and (c) of the graph of FIG. 6, the dashed lines horizontally-connecting the plotted speed data of each nozzle, are provided for reference to graphically understand the ejection variations of each nozzle before polarization adjustment. The horizontal solid line is also provide as a reference line after the polarization adjustment of the invention.

As shown in FIG. 6(*a*), the droplet ejection speeds in each nozzles of the recording head 10, before polarization adjustment, have variation near the 7 m/s ejection speed. Because of this speed variation, the impact positions of droplet are varied on the sheet 1, and the recording quality degrades. The nozzles of No. 1 and No. 3 (from a1 and a3) are approximately 7 m/s, and these speeds are substantially same value. Accordingly, the flight positions in FIG. 2 are close in the direction of droplet ejection. However, the ejection speeds in the nozzles of No. 4, No. 5 and No. 8 (from a4, a5, and a8) are over 7 m/s. As a result, droplet flight positions in these nozzles of No. 4, No. 5 and No. 8 are closer to the sheet 1 than those in the No. 1 and No. 3 nozzles. On the contrary, the droplet ejection speeds in the nozzles of No. 2, No. 6, No. 7, and No. 9 (from a2, a6, a7, and a9) are less than 7 m/s. Therefore, the flight positions of the droplets from these No. 2, No. 6, No. 7, and No. 9 are closer to each nozzle 104 than those from No. 1 and No. 3.

In an image forming apparatus, recording is done by the striking of droplets on sheet 1, which is moved with respect to the recording head 10. When the droplet striking positions on the sheet 1 are varied according to the variations of the droplet flight position in FIG. 2, the recording image quality degrades. Therefore, to keep the recording quality of the recording apparatus, it is desirable to reduce the variations of droplet ejection speeds for each nozzle.

Thus, the variation of the droplet ejection speeds as described above can be adjusted by adjusting the polarization degree of the piezoelectric element 130. Therefore, in this embodiment, as described below, the polarization adjustment is performed by applying a prescribed re-polarization voltage (polarization pulse) to each piezoelectric element, and the polarization adjustment is performed accurately in accordance with the observed variations prior to re-polarization. Therefore, the droplet ejection speeds of all (or selected ones of) nozzles in No. 1 to No. 9 nozzles as described above can be adjusted to be within a variation about 7.0+/−0.2 m/s, as shown in FIG. 6(*c*).

Figure 4:
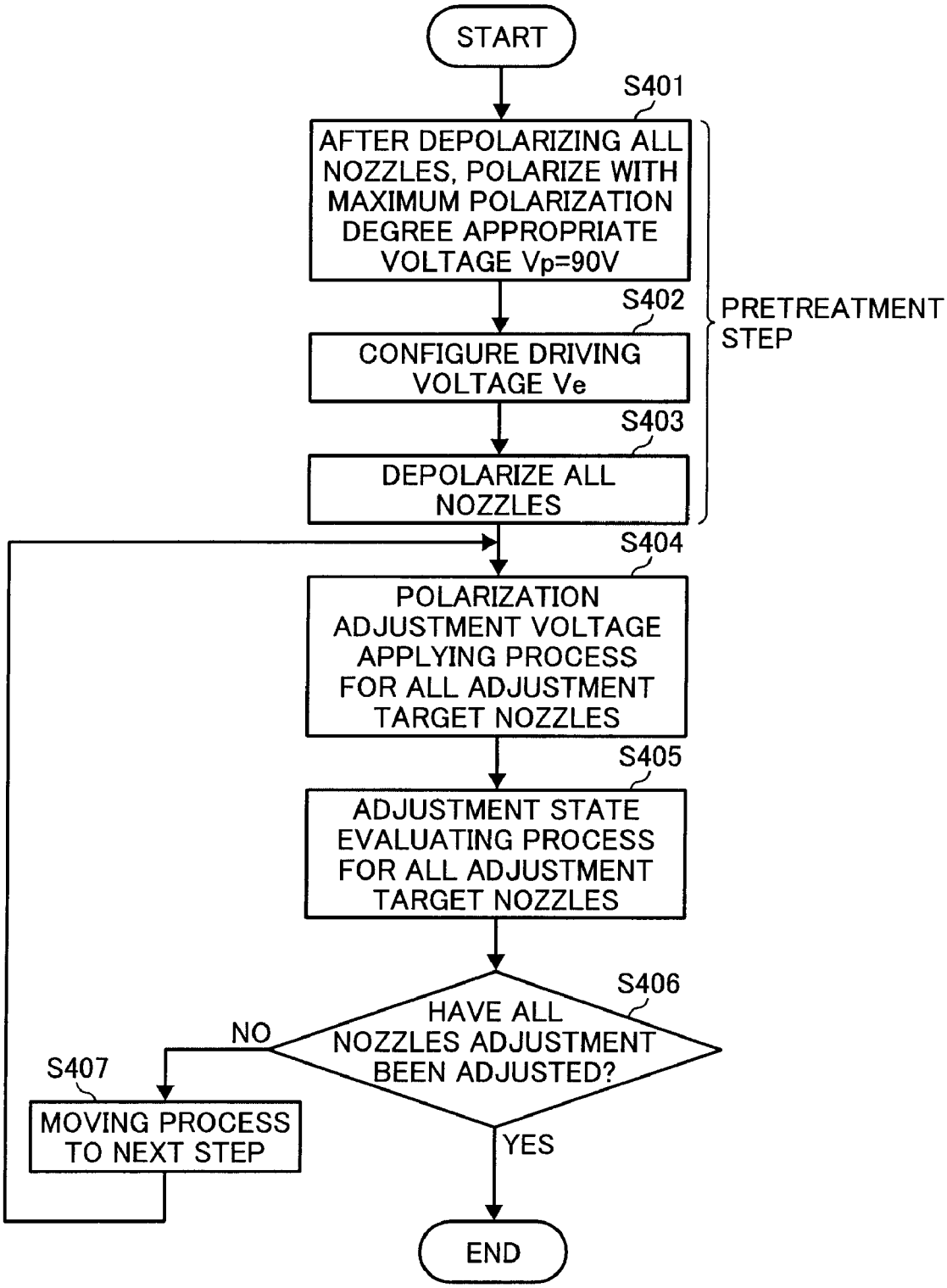
FIG. 4 is a flowchart for an explanation of polarization adjustment operation with an image forming apparatus

FIG. 4 is a flowchart to explain the details of parallel progressive polarization adjustment operation in one embodiment of the invention. The details of parallel progressive polarization adjustment operation will be described with reference to FIG. 6 described above and with reference to FIG. 7 which is a droplet ejection speed characteristic graph. This polarization adjustment operation has three processes: a pretreatment process, a polarization adjustment voltage applying process, and a polarization adjustment condition evaluation process. A series of these processes is performed by the process control device 50 controlling the recording signal source 40 and the recording signal source 40 and the like. Hereinafter, it will be described as an example of the case that all nozzles of No. 1 to No. 9 of the line-type recording head 10 are targeted in an adjustment, and the characteristics of variation of each droplet speed in these nozzles before the adjustments are displayed by FIG. 6(*a*).

First, in the pretreatment steps (S401, S402, S403), first each piezoelectric actuator of all nozzles is depolarized. Next, in this process, the piezoelectric actuator 130 is polarized with a polarization voltage (e.g., maximum polarization degree obtained by an appropriate applied voltage) to provide a "maximum" polarization degree to the piezoelectric actuator 130, for example, by an applied polarization voltage of 90 V being generated in the polarization pulse generating circuit 404 (S401). "Maximum: refers to the polarization obtained after application of the 90 V polarization voltage.

In the maximum polarization degree state, each piezoelectric actuator 130 of all nozzles is driven for droplet ejection, and a ejection driving voltage Ve is configured to produce a nominal droplet ejection speed Vj=7 (m/s) in the nozzle (S402). And next, to be prepared for an adjustment as described below, the polarization of each polarization element 130 for all (or selected ones of) nozzles is depolarized at once (in FIG. 4, this is displayed as "all nozzles depolarization") (S403). With reference to FIG. 6(*b*), depolarization (for example by heating above the Curie temperature of the piezoelectric elements) is needed in order to return almost all the nozzles to a condition where a more appropriate polarizing voltage can thereafter be applied in order to obtain the target ejection speed of 7 m/s. Only nozzle No. 6 in FIG. 6(*b*) would not have to be depolarized following the maximum polarization.

For example, in the case of shown in FIG. 6(*a*), the droplet ejection speed Vj of a droplet from No. 6 nozzle is the lowest. When the maximum polarization pulse of 90 V is provided and when each polarization element 130 of No. 1 to No. 9 nozzles is driven to the maximum polarization degree state, then a standard ejection driving voltage is configured to be set to an ejection driving voltage of Ve=Ve7, or for example, Ve=28 volts. FIG. 6(*b*) shows that the droplet ejection speed Vj of an ejection droplet from No. 6 nozzle will have the target speed of 7 m/s. The variation characteristics of droplet ejection speeds between from No. 1 to No. 9 nozzles become as shown in FIG. 6(*b*). Therefore, by depolarizing the other piezoelectric elements 130 (except responding No. 6) of the nozzles and then applying an appropriate voltage under 90V, their polarization degrees are configured to have appropriate values (i.e., the ejection speed of No. 6 nozzle), and also their droplet ejection speeds are reduced as compared to that in FIG. 6(*b*). As a result, the droplet ejection speeds of all nozzles are adjusted to the target speeds, e.g. 7+/−0.2 m/s.

Thus, after performing the polarization adjustment voltage applying process (step) (S404) of applying the polarization adjustment voltage to all adjustment target nozzles of the invention, an adjustment state evaluation process (step) (S405) of evaluating adjustment condition for potential adjustment of all the target nozzles is performed. Thereafter, if the adjustments for all nozzles are not completed, a step to move to the next step (the step being that polarization adjustments for the uncompleted nozzles are performed) is performed (S406). Next, the polarization adjustment voltage applying process and the adjustment state evaluation process are repeated (S407). If there has been an appropriate adjustment for all nozzles, then the process is finished.

Figure 5A:
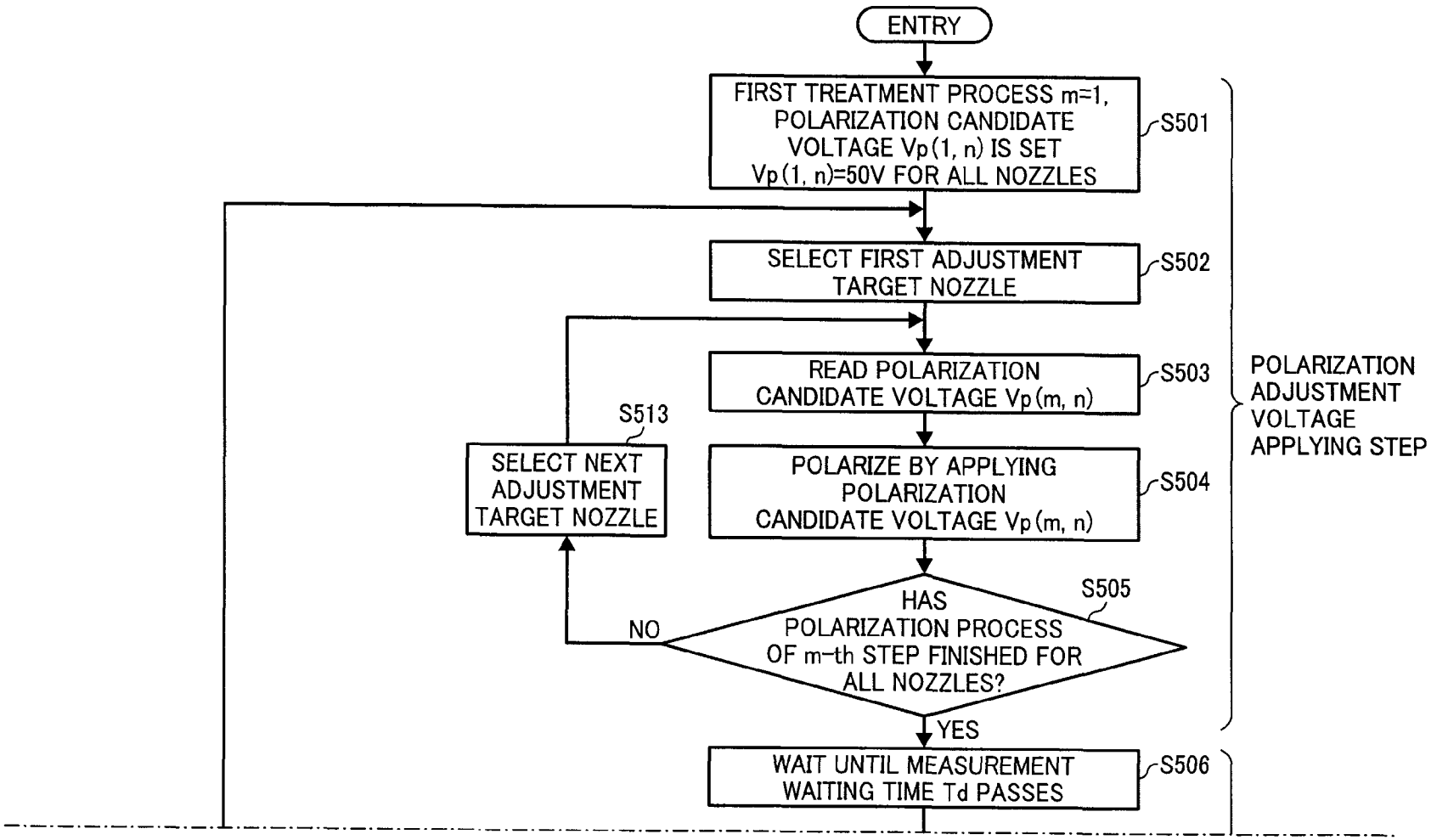
FIG. 5 is a flowchart for an explanation of polarization adjustment voltage applying treatment and adjustment conditions evaluation treatment.
Figure 5B:
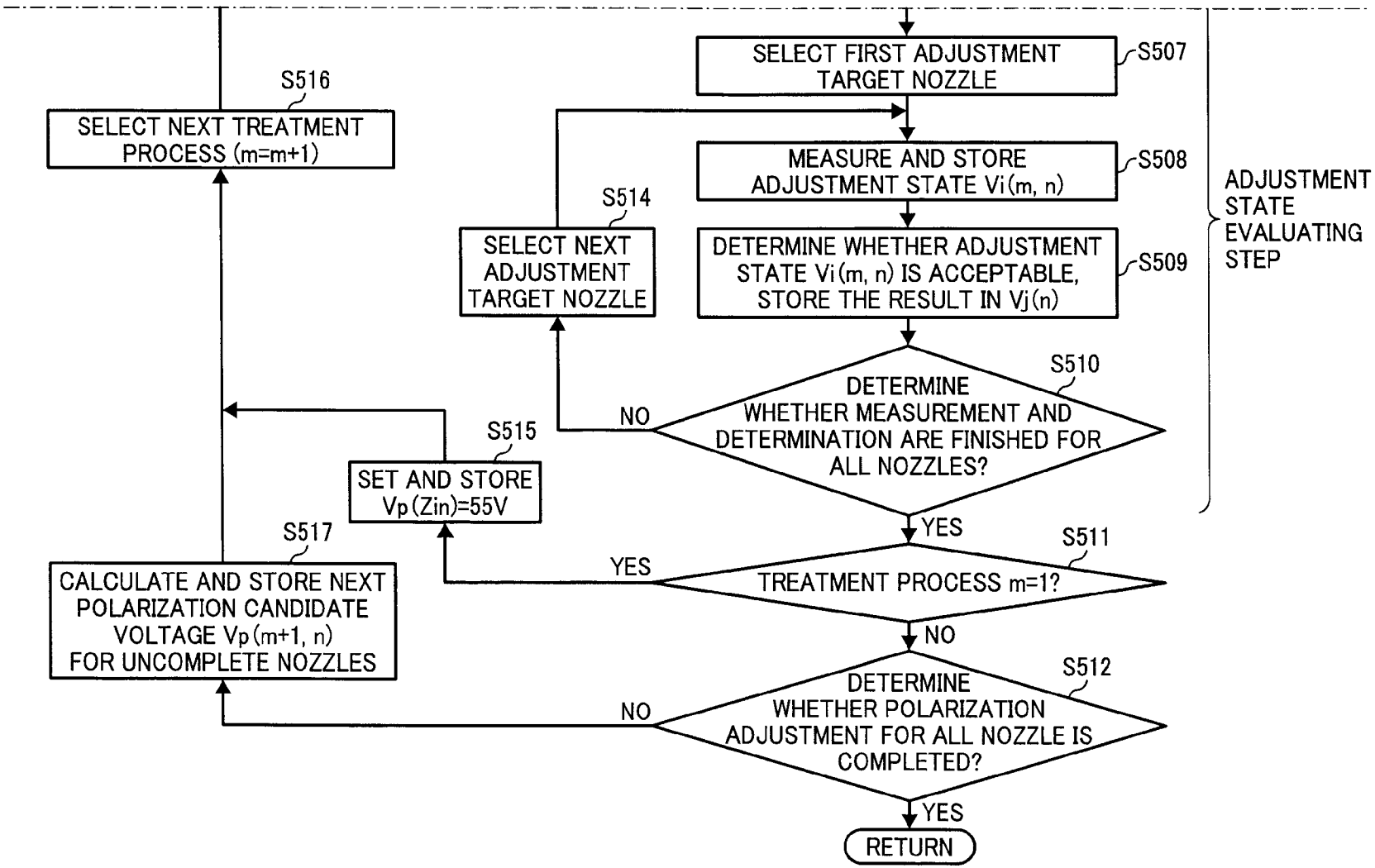

Regarding the polarization adjustment voltage applying process (step), the adjustment state evaluation process (step) and the next step moving process (S407) will be described with reference to FIGS. 5A and 5B. Firstly, in the polarization adjustment voltage applying process (step), a polarization treatment step m is set as a first treatment process (m=1), a polarization candidate voltage Vp(1,n) in the piezoelectric element 130 in response to all nozzles for adjustment target is set as a predetermined voltage (here, the voltage is as 50V, as an example), and the set polarization candidate voltage is stored in the polarization voltage memory for each nozzle 401A (S501). Further, in a "polarization treatment process m," the "m" represents the number of times of a single process with one time of the polarization adjustment process, and in the adjustment state evaluation process, "n" represents the nozzle No. n.

Next, the adjustment nozzle is selected (S502), the polarization candidate voltage Vp(m,n) is read from polarization voltage memory for each nozzle 401A (S503), a polarization pulse for the polarization candidate voltage Vp(m,n) from the polarization pulse generating circuit 404 is applied to the piezoelectric element 130 in response to the nozzle of adjustment target (S504). Next, a determination is made as to whether the polarization process (i.e., the polarization candidate voltage applying process) of m-th step for all nozzles is finished or not (S505). If the polarization process of m-th step for all nozzles is not finished, the next adjustment targeting nozzle is selected (S513), and the control process returns to the process of applying the polarization pulse of the polarization candidate voltage Vp(m,n) to the piezoelectric element 130 according to the next adjustment targeting nozzle. Accordingly, the polarization candidate voltage Vp(m,n) is applied to the each piezoelectric element 130 of all (or selected ones of) nozzles, and the each piezoelectric element 130 is polarized.

After finishing the polarization adjustment voltage applying process (step), waiting until a predetermined measurement waiting time Td passes (S506), after a lapse of the predetermined measurement waiting time Td, the control process moves on to the adjustment state evaluation process (step).

In the adjustment state evaluation process (step), the first target nozzle is selected (S507), an adjustment state vi(m,n) is measured for a polarization adjustment of the polarization treatment process m and treatment target nozzle n, the adjustment state vi(m,n) is stored in the field for the process target nozzle of the polarization state memory for each nozzle 401C (S508). A determination is made as to whether the stored adjustment state vi(m,n) is acceptable or not, the determined result vj(n) is stored in the field for the process target nozzle of the droplet ejection speed for each nozzle 401B (S509). Next, a determination is made as to whether the measurement and determination are finished or not for the all adjustment target nozzles (S510). If the measurement and determination for all nozzles are not finished, the next adjustment target nozzle is selected (S514). The next adjustment target nozzle is performed for the process of the measurement and determination in the same way. On the other hand, if the measurement and the determination for all nozzles are finished, the adjustment state evaluation process (step) will be ended. Therefore, the determined results vj(n) for all nozzles for adjustment to a target polarization are stored in the droplet ejection speed memory for each nozzle 401B.

Next, a determination is made as to whether the polarization treatment process m is 1 (m=1) (S511). If the polarization treatment process m is 1, the polarization candidate voltage Vp(2,n) is set at 55V and stored (S515). Next treatment process is selected (m=m+1=2) by incrementing (+1) the polarization treatment process m (S516). Afterwards, the polarization candidate voltage Vp(2,n) (=55V) is applied, and the polarization state determination step is performed.

On the other hand, if the adjustment treatment process m is not m=1, a determination is made as to whether the polarization adjustment for all nozzles is completed (S512). In other words, a determination is made as to whether the determined results vj(n) of all nozzles are within the acceptable range. If the determined results vj(n) of all nozzles are not within the acceptable range, a polarization candidate voltage calculation unit 402 calculates the next polarization candidate voltage Vp(m+1,n) for the adjustment target nozzles ("uncompleted nozzles") that those determined results vj(n) are not within the acceptable range. The next polarization candidate voltage Vp(m+1,n) is stored in the polarization voltage memory for each nozzle 401A (S517), the next treatment process is selected (m=m+1) by incrementing (+1) the polarization treatment process m, the polarization adjustment voltage applying process and the adjustment state evaluating process (S516) described above are performed for the uncompleted nozzles.

Herewith, this process will be ended when the determined results vj(n) for all nozzles are within acceptable range.

It will be described below about the process above-mentioned. Firstly, in the polarization adjustment voltage applying process (step) shown in FIG. 5, as described above, the first treatment process m is set at m=1. The polarization voltage memory 401A is configured such that that the polarization candidate voltages Vp(1,n) for all nozzles are Vp(1, n)=50V. Next, the first treatment target nozzle (n=1: No. 1 nozzle) is selected by the nozzle switching circuit 90, and the polarization candidate voltage Vp(m,n) is read out. In this case, Vp(1,1) is 50V, and the polarization pulses at this voltage are generated from the polarization pulse generating circuit 404 in the polarization signal source 40. Thus, the piezoelectric element 130 of No. 1 nozzle as first treatment target nozzle is polarized by 50V.

Afterwards, No. 2 nozzle (N=2) is selected as next adjustment target nozzle. Vp(1,2)=50V is read out, and the polarization pulse is generated. This is that the piezoelectric element 130 in response to No. 2 nozzle (n=2) is also polarized by 50V. Next, each piezoelectric element 130 corresponding from No. 3 to the last No. n nozzle (in this case, No. 9 nozzle) are also repolarized at 50V by the same process; the polarized process is then ended.

Thus, the polarization adjustment voltage applying process step of repolarizing the piezoelectric element 130 (corresponding to all target nozzles of polarization adjustment on a predetermined polarization condition) is finished. And, after a lapse of predetermined waiting time Td, the control process moves on to the next adjustment state evaluation process step. It has been discovered that, immediately after the polarization voltage is applied to the piezoelectric element 130, polarization degrees of piezoelectric elements 130 vary widely. Thus, the predetermined waiting time Td is a measurement waiting time to avoid adjustment state evaluation during the time in which the polarization degrees can vary widely. Waiting the predetermined time Td increases the precision of any subsequent adjustment. In one embodiment, the predetermined waiting time Td is set to be over 5 minutes, for example.

Then, when moving to the adjustment state evaluation process, the droplet ejection speed of all n nozzles (or selected ones) is measured sequentially and is stored as the adjustment state vi(m=1,n) in the adjustment state memory for each nozzle 401C of the polarization adjustment signal source 40. In the measurement of the droplet ejection speed, the driving pulse voltage from the piezoelectric element driving pulse generating circuit 304 of the recording signal source 30 is configured to Ve=Ve7, and in the nozzle switching circuit 90, the switches in response to n-nozzles 104 are turned ON sequentially. At the same time, under direction from the process control device 50, the ejection speeds of droplets from each nozzle 104 is measured with the droplet ejection characteristic sensor 70.

After these droplet ejection speeds are measured, it is determined whether the droplet ejection speed is the target speed of 7+/−0.2 m/s (i.e., whether there is an acceptable range or not), and the determined results vj(n) are stored in the droplet ejection speed memory for each nozzle 401B. In the treatment process m=1, polarization voltage is 50V, the droplet ejection speed is slower than target speed at 7 m/s, and the determined results vj(n) are "0" in the all nozzles.

Thus, the measurement and determination of the polarization adjustment state for the piezoelectric elements of all adjustment target nozzles are performed.

Next, the treatment process m is set m=2 by incrementing (+1), the next polarization candidate voltage Vp(2,n) is calculated (this calculation is described below), and the Vp(2,n) is set at 55V. Then, as the same in the case of treatment process m=1 above-described, the polarization adjustment voltage applying process step of applying the polarization adjustment voltage (polarization pulses) of Vp(2,n)=55V on each piezoelectric element 130 of all adjustment target nozzles is performed. Next, the polarization adjustment state evaluating process step is performed for all adjustment target nozzles, and then an adjustment state vi(2,n) is obtained. Afterwards, the vj(n) in the droplet ejection memory for each nozzle 401B is rewritten by the adjustment state vi(2,n) as the treatment process m=2. Further, in the polarization candidate voltage (2,n)=55V, the droplet ejection speed is slower than target speed at 7 m/s, and the determined results vj(n) are "0" in the all nozzles 104.

Next, the treatment process m is set m=3 by incrementing (+1), a polarization voltage Vp(3,n) when the droplet ejection speeds of each nozzle 104 are 7 m/s, is predictive calculated on the basis of Vp(1,n), Vp(2,n), vi(1,n) and vi(2,n), by using the following approximation expression (1).

$$Vp(3,n)=Vp(2,n)+\Delta Vp(2,n) \quad (1)$$

where $$\Delta Vp(2,n)=k(2,n)\times(7-vi(2,n))\times(Vp(2,n)-Vp(1,n))/(vi(2,n)-vi(1,n))$$

By predictive calculations, the polarization voltage Vp(3,n) for the subsequent the polarization voltage applying process step is performed for all (or selected ones of) nozzles of adjustment target, and the polarization adjustment evaluating process step is performed. In the polarization state evaluating process step, the adjustment process step for the nozzles of the droplet ejection speed being the target speed of 7+/−0.2 m/s are completed. Then, in the next process step, the adjustment process step for the uncompleted adjustment nozzles is performed continually.

This process is defined as m+1 process, The polarization voltage in the process is computed from the following expression (2)

$$Vp(m+1,n)=Vp(m,n)+\Delta Vp(m,n) \quad (2)$$

where $$\Delta Vp(m,n)=k(m,n)\times(7-vi(m,n))\times(Vp(m,n)-Vp(m-1,n))/(vi(m,n)-vi(m-1,n))$$

In the expression (2), k(m,n) is set at 0.1~2.0 approximately in view of the convergence speed to a target speed, and the accuracy.

By repeating the process as described above, all (or selected ones of) nozzles are set to a target speed.

Figure 7:
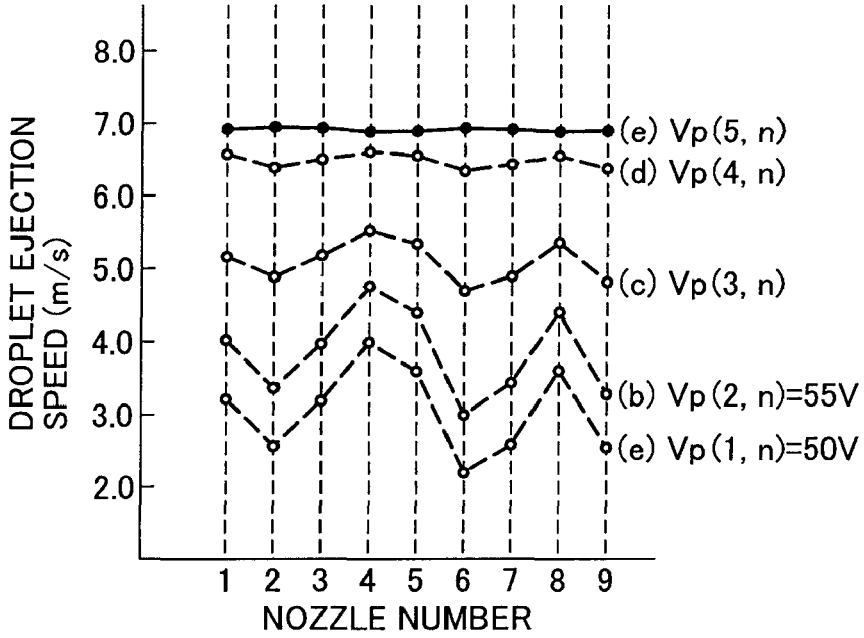

In the example shown in FIG. 7, the droplet ejection speeds of all nozzles are configured to a target speed by the first treatment process (m=1) that the polarization voltage is Vp(1,n)=50V, the second treatment process (m=2) that the polarization voltage is Vp(2,n)=55V, the third treatment process (m=3) that the polarization voltage is Vp(3,n), the fourth treatment process (m=4) that the polarization voltage is Vp(4,n), and the fifth treatment process (m=5) that the polarization voltage is Vp(5,n). Some nozzles finish the polarization adjustment early because their nozzles get to the acceptable target speed in few times (m) of treatment process. However, it is preferable that the polarization voltages are set such that the polarization adjustments occur with as many of nozzles as possible being finished in the same time. Further, if early completion nozzles exist, those nozzles as determined by the recorded data as the determined result vj(n), in the next polarization adjustment process steps, are skipped for these early completion nozzles.

As stated above, in the embodiment of present invention, polarization adjustments for a set of the each nozzles are performed in parallel. Therefore, even if there are many polarization target nozzles (with adjustments for target nozzles) as in a line-type recording head, the polarization adjustment finish time for the all nozzles on the line-type recording head can fall within a short period of time. Thus the polarization adjustment for all nozzles to be adjusted in the repolarization adjustment environment condition occurs when that the recording head and ink are under substantially the same temperature during the adjustment period and, the measurement condition is under the same condition. Thus, the polarization adjustments are performed with high precision.

The polarization adjustment voltage applying process of the embodiment described above is explained below by which the disadvantages of the method of repolarizing the piezoelectric elements corresponding each nozzle one by one is overcome. If the repolarization is performed with the same voltage, each switching element 60*s* corresponding to the adjustment target nozzle in the switching element array 60 turns on. Then, by applying the polarization voltage pulse simultaneously, this makes it possible to repolarize by one time all of the selected piezoelectric elements in parallel. Further, in one embodiment, plural units combining the switching element array 60 and the driving pulse generating circuit 304 are equipped for separate nozzle groups. In this embodiment, the polarization of all or selected ones of the nozzles can be performed simultaneously by application of plural repolarization voltages from the plural unit to the separate nozzle groups. By such a configuration, the amount of time required to perform the polarization adjustment voltage applying process can be reduced.

The adjustment state evaluating process is explained below by which the disadvantages of the method of performing for each nozzle one by one is overcome. If the measurement of the droplet ejection speed for each nozzles is performed in parallel, the time of the adjustment state evaluating process can also be reduced dramatically. Such measurement can be performed by using conventional technologies, for example, an optical detection device using a CCD array with one or more CCD element corresponding each nozzle, etc.

Further, with regard to adjusting a droplet ejection speed by polarization adjustment, it is known that the droplet ejection volume is adjustable in an adjustment of a repolarization voltage, besides the ejection speed adjustability. Therefore, in one embodiment of the invention similar to that described above, the droplet ejection voltage can be changed in a similar fashion as the change from the droplet ejection speed was used before. This makes it possible to record width variations in droplet ejection volume of each of the nozzles in comparison to each other.

Figure 8:
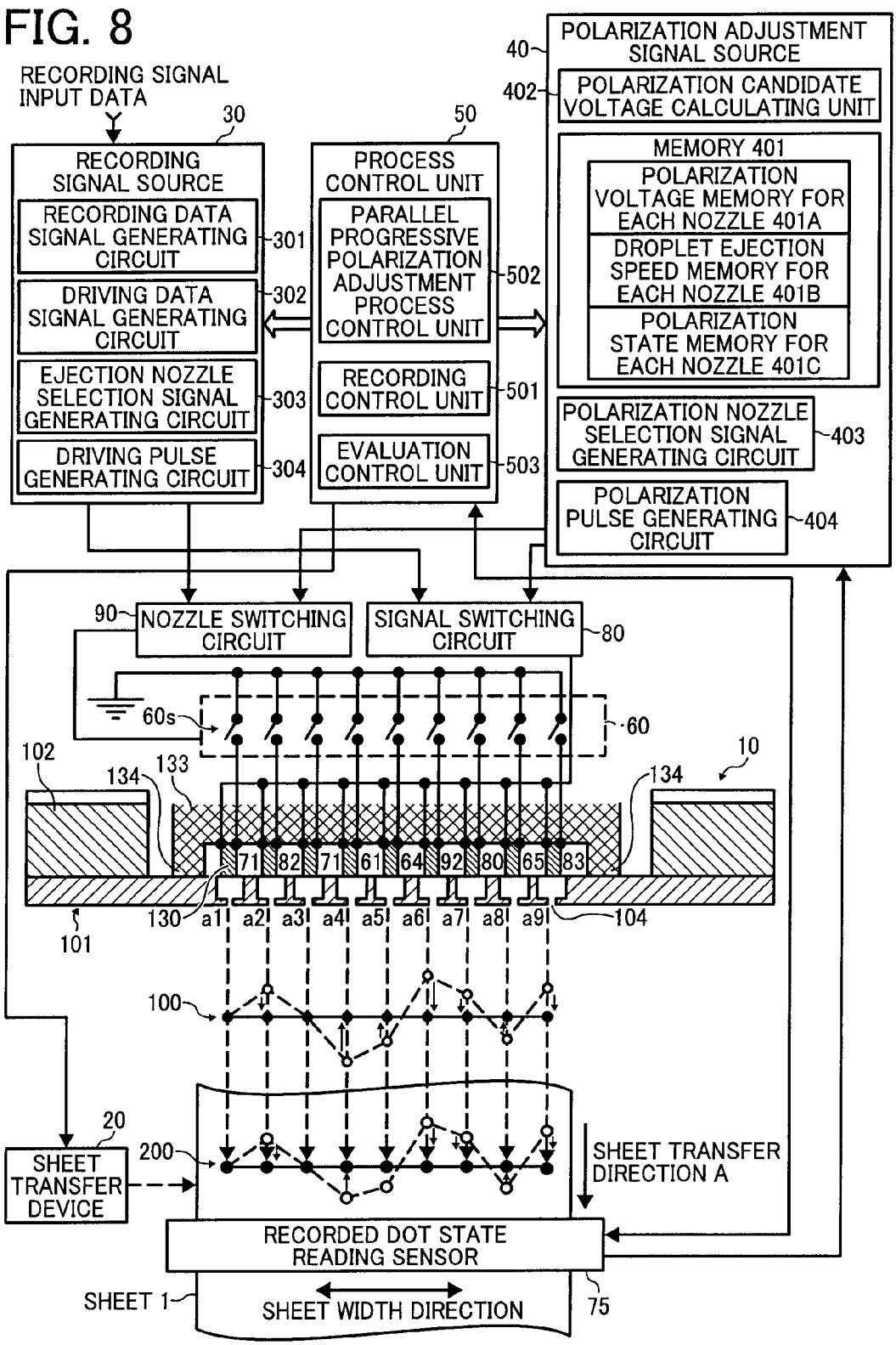
FIG. 8 is an explanatory diagram of an image forming apparatus in accordance with another embodiment of the prevent invention.

Further, the droplet ejection characteristic measurement device (unit) was described in examples where the droplet ejection speeds or the droplet ejection volumes are measured by the droplet ejection characteristic measurement sensor which can read the droplet flying state by optical, etc. As shown in FIG. 8, a recorded dot state reading sensor 75 can be placed in downstream from the recording head 10 in sheet transfer direction A, opposite a face of the sheet 1 to read recorded results on the sheet 1, and in width direction of the sheet 1. And, the state for the droplet ejection speed or the droplet ejection volume is measured (detected) from the recorded results.

Namely, the measurement method of a droplet ejection speed of a droplet ejecting from a nozzle is that the driving pulse voltage Ve from the driving pulse generating circuit 304 is set at Ve7, the switches for n-nozzles in the nozzle switching circuit 90 are turned on sequentially. In the same time, the sheet transferring device 20 is activated by an instruction from the process control device 50, the sheet 1 is transferred to the sheet transferring direction A, and the recorded dots are recorded on the sheet 1. These recorded dots are read by the recorded dot state reading sensor 75, a displacement of the recorded dot from a reference recording point is detected. If the ejection speed of droplet is faster than a target speed, the recorded dot is formed on a downstream side of the sheet. If the ejection speed of droplet is slower than a target speed, the recorded dot is formed on a upstream side of the sheet. By measuring the amount of displacement from a reference recording point, the droplet ejection speed is measured. Further, the volume of a droplet can be measured by reading the size and density of a recorded dot.

In the above embodiment, the line-type ink jet recording apparatus (i.e., an image forming apparatus) is described. However, these techniques have applicability to the head manufacturing device. That is, the recording head is configured to be detachable easily form the head manufacturing device. The recording head before being adjusted is set in the device. The polarization adjustment as described above is completed. The recording head after being adjusted is removed from the device, and the polarization adjusted recording head is made. By repeating this adjustment process, the head of narrow range of variation in the speed between nozzles can be made. Further, plural recording heads are set in the device, by adjusting these heads as one head, it can improve productivity. The variation of speed between the recording head can be adjusted with high dimensional accuracy. Moreover, plural adjustment devices are set for one head, and concurrently a running level of the polarization adjustment process is realized, making the adjustment time for each new head short.

Meanwhile, the image forming apparatus and the head manufacturing device according to the invention are not limited to an ink jet recording device or the manufacture of an ink jet recording head. The invention is applicable to a marking device on products or industrial liquid distribution device like a coating device.

Numerous modifications and variations of the invention are possible in light of the above teachings. It is therefore to be understood that within the scope of the appended claims, the invention may be practiced otherwise than as specifically described herein.

The invention claimed is:

1. A method for adjusting uniformity of liquid ejection from a liquid ejection head, comprising:

determining a first polarization voltage and a second polarization voltage based on polarization degrees for a set of piezoelectric elements corresponding to nozzles of the liquid ejection head; and adjusting polarization degrees selectively for each one of the set of the piezoelectric elements in parallel based on the determined first polarization voltage of said set of the piezoelectric elements, wherein adjusting comprises:

applying the first polarization voltage to the piezoelectric elements;

evaluating first polarization degrees of the piezoelectric elements a predetermined time after application of said first polarization voltage; and applying the second polarization voltage to selected ones of the piezoelectric elements;

evaluating second polarization degrees of said ones of the piezoelectric elements after application of the second polarization voltage; and determining if further polarization adjustment is required;

wherein further polarization adjustment comprises:

calculating a next polarization voltage from said first and second polarization voltages and said first and second polarization degrees; and applying the next polarization voltage to selected ones of the piezoelectric elements in parallel.

2. The method according to claim 1, wherein said determining a first polarization voltage and a second polarization voltage comprises:

determining said first polarization voltage and said second polarization voltage such that the polarization adjustments occur with as many of nozzles as possible being finished in the same time.

3. The method according to claim 1, further comprising:

depolarizing said selected ones of the piezoelectric elements prior to applying the second polarization voltage.

4. The method according to claim 1, further comprising:

evaluating the polarization degrees by measurement of a droplet ejection characteristic from said nozzles.

5. The method according to claim 4, wherein said droplet ejection characteristic for evaluating the polarization degrees is an ejection speed.

6. The method according to claim 5, wherein evaluating comprises:

imaging droplets ejected from said nozzles at different elapsed times after piezoelectric element activation.

7. The method according to claim 4, further comprising:

evaluating the polarization degrees by measurement of respective droplet ejection speeds from said nozzles onto a recording medium transiting under the liquid injection head.

8. The method according to claim 4, wherein said droplet ejection characteristic for evaluating the polarization degrees is a droplet volume.

9. The method according to claim 8, wherein evaluating comprises:

imaging droplets ejected from said nozzles after piezoelectric element activation to obtain a size of the droplets.

10. The method according to claim 1, wherein calculating comprises:

computing said next polarization voltage from the following expression:

$$Vp(m+1,n)=Vp(m,n)+\Delta Vp(m,n),$$

where m is a number of a polarization treatment process and n is a target nozzle number, and $$\Delta Vp(m,n)=k(m,n)\times(7-vi(m,n))\times(Vp(m,n)-Vp(m-1,n))/(vi(m,n)-vi(m-1,n)).$$

* * * * *